US007153338B2

(12) United States Patent
Bangaru et al.

(10) Patent No.: US 7,153,338 B2
(45) Date of Patent: Dec. 26, 2006

(54) ADVANCED EROSION RESISTANT OXIDE CERMETS

(75) Inventors: Narasimha-Rao Venkata Bangaru, Annandale, NJ (US); ChangMin Chun, Belle Mead, NJ (US); Hyun-Woo Jin, Phillipsburg, NJ (US); Jayoung Koo, Bridgewater, NJ (US); John Roger Peterson, Ashburn, VA (US); Robert Lee Antram, Warrenton, VA (US); Christopher John Fowler, Springfield, VA (US)

(73) Assignee: Exxonmobil Research and Engineering Company, Annandale, NJ (US)

( * ) Notice: Subject to any disclaimer, the term of this patent is extended or adjusted under 35 U.S.C. 154(b) by 75 days.

(21) Appl. No.: 10/829,821

(22) Filed: Apr. 22, 2004

(65) Prior Publication Data

US 2006/0137486 A1 Jun. 29, 2006

Related U.S. Application Data

(60) Provisional application No. 60/471,792, filed on May 20, 2003.

(51) Int. Cl.
*C22C 29/12* (2006.01)
*C22C 33/00* (2006.01)

(52) U.S. Cl. ..... 75/235; 75/246; 428/545

(58) Field of Classification Search ..... 75/252, 75/232, 235, 246; 428/545
See application file for complete search history.

(56) References Cited

U.S. PATENT DOCUMENTS

| | | | | | |
|---|---|---|---|---|---|
| 3,070,439 | A | * | 12/1962 | Grant et al. | 419/19 |
| 3,533,760 | A | * | 10/1970 | Fraser et al. | 75/252 |
| 3,864,093 | A | * | 2/1975 | Wolfla | 428/564 |
| 3,941,903 | A | | 3/1976 | Tucker, Jr. | 427/190 |
| 4,101,713 | A | * | 7/1978 | Hirsch et al. | 428/554 |
| 4,379,852 | A | | 4/1983 | Watanabe et al. | 501/87 |
| 4,392,927 | A | | 7/1983 | Fabian et al. | 204/98 |
| 4,426,423 | A | | 1/1984 | Intrater et al. | 428/408 |
| 4,475,983 | A | | 10/1984 | Bader et al. | 156/656 |
| 4,501,799 | A | | 2/1985 | Driessen et al. | 428/446 |
| 4,515,866 | A | | 5/1985 | Okamoto et al. | 428/614 |
| 4,533,004 | A | | 8/1985 | Ecer | 175/329 |
| 4,535,029 | A | | 8/1985 | Intrater et al. | 428/408 |
| 4,552,637 | A | | 11/1985 | Vire et al. | 204/243 R |
| 4,596,994 | A | | 6/1986 | Matsuda et al. | 346/140 R |
| 4,610,810 | A | | 9/1986 | Hasegawa et al. | 252/511 |
| 4,615,913 | A | | 10/1986 | Jones et al. | 427/226 |
| 4,643,951 | A | | 2/1987 | Keem et al. | 428/469 |
| 4,659,379 | A | | 4/1987 | Singh et al. | 75/234 |
| 4,681,671 | A | | 7/1987 | Duruz | 204/67 |
| 4,682,987 | A | | 7/1987 | Brady et al. | 51/293 |
| 4,696,764 | A | | 9/1987 | Yamazaki | 252/503 |
| 4,705,565 | A | | 11/1987 | Beltz et al. | 75/235 |
| 4,707,384 | A | | 11/1987 | Schachner et al. | 427/249 |
| 4,711,660 | A | | 12/1987 | Kemp, Jr. et al. | 75/0.5 B |
| 4,734,339 | A | | 3/1988 | Schachner et al. | 428/701 |
| 4,790,873 | A | | 12/1988 | Gesing et al. | 75/68 R |
| 4,806,161 | A | | 2/1989 | Fabiny et al. | 106/14.12 |
| 4,822,759 | A | | 4/1989 | Newkirk et al. | 501/127 |
| 4,824,622 | A | | 4/1989 | Kennedy et al. | 264/59 |
| 4,838,936 | A | | 6/1989 | Akechi | 75/249 |
| 4,847,025 | A | | 7/1989 | White et al. | 501/87 |
| 4,851,375 | A | | 7/1989 | Newkirk et al. | 501/88 |
| 4,873,038 | A | | 10/1989 | Rapp et al. | 264/60 |
| 4,889,745 | A | | 12/1989 | Sata | 427/12 |
| 4,935,055 | A | | 6/1990 | Aghajanian et al. | 164/66.1 |
| 4,948,676 | A | | 8/1990 | Darracq et al. | 428/539.5 |
| 4,950,327 | A | | 8/1990 | Eck et al. | 75/232 |
| 4,960,643 | A | | 10/1990 | Lemelson | 428/408 |
| 4,962,070 | A | | 10/1990 | Sullivan | 501/95 |
| 4,995,444 | A | | 2/1991 | Jolly et al. | 164/97 |
| 5,004,036 | A | | 4/1991 | Becker | 164/97 |
| 5,010,945 | A | | 4/1991 | Burke | 164/97 |
| 5,045,512 | A | | 9/1991 | Lange et al. | 501/96 |
| 5,051,382 | A | | 9/1991 | Newkirk et al. | 501/87 |
| 5,242,363 | A | * | 9/1993 | Nitta et al. | 492/54 |
| 5,281,487 | A | * | 1/1994 | Rumaner et al. | 428/552 |
| 5,455,119 | A | * | 10/1995 | Taylor et al. | 428/632 |
| 6,022,508 | A | | 2/2000 | Berns | 419/6 |
| 6,372,012 | B1 | | 4/2002 | Majagi et al. | 75/236 |
| 6,544,636 | B1 | | 4/2003 | Fukunaga et al. | 428/293.1 |

(Continued)

FOREIGN PATENT DOCUMENTS

EP 0426608 5/1991

(Continued)

OTHER PUBLICATIONS

Tien, C., et al., "Magnetic properties of a cerment on the base of A1203," Journal of Magnetism and Magnetic Materials, Elsevier Science Publishers, Amsterdam, NL, vol. 220, No. 2-3, Oct. 2000, pp. 147-151.

*Primary Examiner*—Ngoclan T. Mai
(74) *Attorney, Agent, or Firm*—Ramesh Varadaraj; Robert A. Migliorini

(57) ABSTRACT

One embodiment of the invention includes a cermet composition represented by the formula (PQ)(RS) comprising: a ceramic phase (PQ) and a binder phase (RS) wherein, P is a metal selected from the group consisting of Al, Si, Mg, Ca, Y, Fe, Mn, Group IV, Group V, Group VI elements, and mixtures thereof, Q is oxide, R is a base metal selected from the group consisting of Fe, Ni Co, Mn and mixtures thereof, S consists essentially of at least one element selected from Cr, Al and Si and at least one reactive wetting element selected from the group consisting of Ti, Zr, Hf, Ta, Sc, Y, La, and Ce.

23 Claims, 6 Drawing Sheets

U.S. PATENT DOCUMENTS 6,649,682 B1 * 11/2003 Breton et al. ..... 524/404

FOREIGN PATENT DOCUMENTS

JP 60089543 9/1985
JP 60100646 9/1985
JP 60200948 3/1986
JP 61149454 11/1986

* cited by examiner

ADVANCED EROSION RESISTANT OXIDE CERMETS

This application claims the benefit of U.S. Provisional application 60/471,792 filed May 20, 2003.

FIELD OF INVENTION

The present invention is broadly concerned with cermets, particularly cermet compositions comprising a metal oxide. These cermets are suitable for high temperature applications wherein materials with superior erosion and corrosion resistance are required.

BACKGROUND OF INVENTION

Erosion resistant materials find use in many applications wherein surfaces are subject to eroding forces. For example, refinery process vessel walls and internals exposed to aggressive fluids containing hard, solid particles such as catalyst particles in various chemical and petroleum environments are subject to both erosion and corrosion. The protection of these vessels and internals against erosion and corrosion induced material degradation especially at high temperatures is a technological challenge. Refractory liners are used currently for components requiring protection against the most severe erosion and corrosion such as the inside walls of internal cyclones used to separate solid particles from fluid streams, for instance, the internal cyclones in fluid catalytic cracking units (FCCU) for separating catalyst particles from the process fluid. The state-of-the-art in erosion resistant materials are chemically bonded alumina castable refractories. These alumina castable refractories are applied to the surfaces in need of protection and upon heat curing hardens and adheres to the surface via metal-anchors or metal-reinforcements. The alumina castable refractory readily bonds to other refractory surfaces. The typical chemical composition of one commercially available chemically bonded alumina castable refractory is 80.0% $Al_2O_3$, 7.2% $SiO_2$, 1.0% $Fe_2O_3$, 4.8% MgO/CaO, 4.5% $P_2O_5$ in wt %. The life span of the state-of-the-art refractory liners is significantly limited by excessive mechanical attrition of the liner from the high velocity solid particle impingement, mechanical cracking and spallation. Therefore there is a need for materials with superior erosion and corrosion resistance properties for high temperature applications. The cermet compositions of the instant invention satisfy this need.

Ceramic-metal composites are called cermets. Cermets of adequate chemical stability suitably designed for high hardness and fracture toughness can provide an order of magnitude higher erosion resistance over refractory materials known in the art. Cermets generally comprise a ceramic phase and a binder phase and are commonly produced using powder metallurgy techniques where metal and ceramic powders are mixed, pressed and sintered at high temperatures to form dense compacts.

The present invention includes new and improved cermet compositions.

The present invention also includes cermet compositions suitable for use at high temperatures.

Additionally, the present invention includes an improved method for protecting metal surfaces against erosion and corrosion under high temperature conditions.

These and other objects will become apparent from the detailed description which follows.

SUMMARY OF INVENTION

One embodiment of the invention includes a cermet composition represented by the formula (PQ)(RS) comprising: a ceramic phase (PQ) and a binder phase (RS) wherein, P is a metal selected from the group consisting of Al, Si, Mg, Ca, Y, Fe, Mn, Group IV, Group V, Group VI elements, and mixtures thereof, Q is oxide, R is a base metal selected from the group consisting of Fe, Ni Co, Mn and mixtures thereof, S consists essentially of at least one element selected from Cr, Al, and Si and at least one reactive wetting element selected from the group consisting of Ti, Zr, Hf, Ta, Sc, Y, La, and Ce.

DETAILED DESCRIPTION OF THE INVENTION

Figure 1:
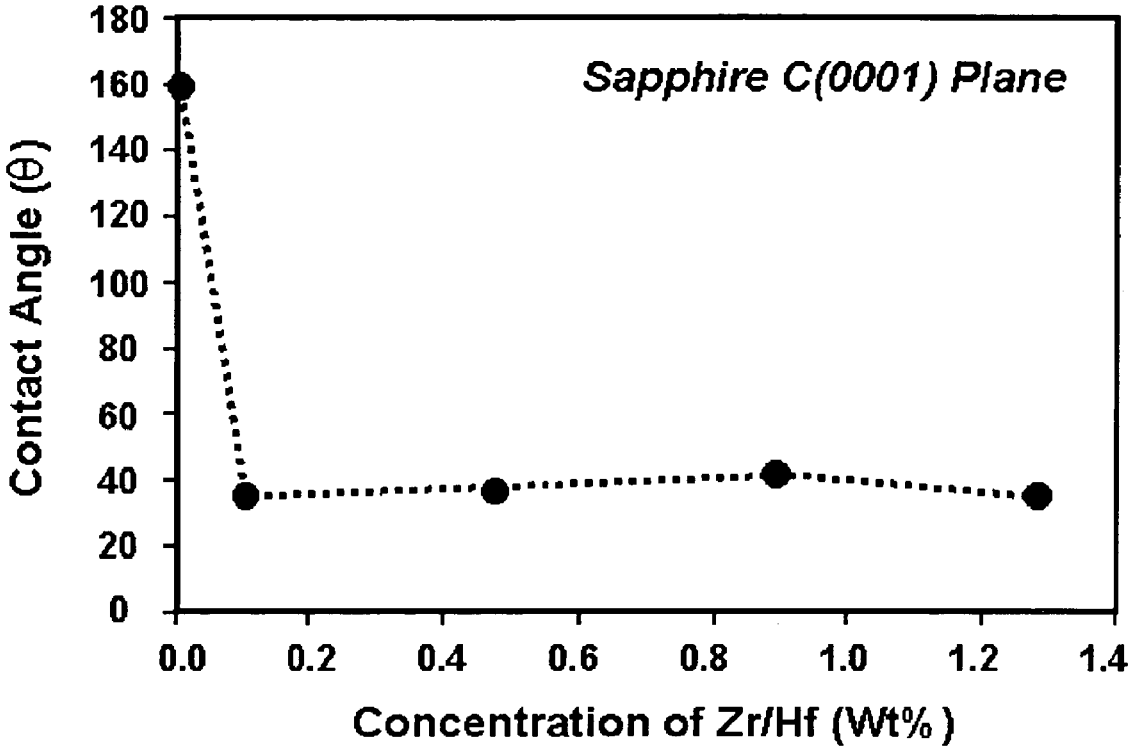
FIG. 1 is a graph showing the contact angle (θ) data for various concentration of Zr/Hf containing modified 304 stainless steel (M304SS) on a sapphire C (0001) plane substrate.

One component of the cermet composition represented by the formula (PQ)(RS) is the ceramic phase denoted as (PQ). In the ceramic phase (PQ), P is a metal selected from the group consisting of Al, Si, Mg, Ca, Y, Fe, Mn, Group IV, Group V, Group VI elements of the Long Form of The Periodic Table of Elements and mixtures thereof. Q is oxide. Thus the ceramic phase (PQ) in the oxide cermet composition is a metal oxide. Aluminum oxide, $Al_2O_3$ is a preferred ceramic phase. The molar ratio of P to Q in (PQ) can vary in the range of 0.5:1 to 1:2.5. As non-limiting illustrative examples, when P=Si, (PQ) can be $SiO_2$ wherein P:Q is about 1:2. When P=Al, then (PQ) can be $Al_2O_3$ wherein P:Q is 1:1.5. The ceramic phase imparts hardness to the oxide cermet and erosion resistance at temperatures up to about 1150° C.

The ceramic phase (PQ) of the cermet is preferably dispersed in the binder phase (RS). It is preferred that the size of the dispersed the ceramic particles is in the range 0.5 to 7000 microns in diameter. More preferably in the range 0.5 to 3000 microns in diameter. The dispersed ceramic particles can be any shape. Some non-limiting examples include spherical, ellipsoidal, polyhedral, distorted spherical, distorted ellipsoidal and distorted polyhedral shaped. By particle size diameter is meant the measure of longest axis of the 3-D shaped particle. Microscopy methods such as optical microscopy (OM), scanning electron microscopy (SEM) and transmission electron microscopy (TEM) can be used to determine the particle sizes.

In another embodiment of this invention, the (PQ) phase is tabular alumina. Tabular alumina is a dense refractory aggregate, a well-sintered, coarse crystalline $\alpha$-$Al_2O_3$. The tabular name comes form its hexagonal tablet-shaped crystal composition. It is popular as an aggregate for alumina-based refractory castables. The cermet made using tabular alumina imparts superior mechanical properties through efficient transfer of load from the binder phase (RS) to the ceramic phase (PQ) during erosion processes.

Another component of the oxide cermet composition represented by the formula (PQ)(RS) is the binder phase denoted as (RS). In the binder phase (RS), R is the base metal selected from the group consisting of Fe, Ni, Co, Mn and mixtures thereof. S is an alloying metal consisting essentially of at least one element selected from Cr, Al and Si and at least one reactive wetting element selected from the group consisting of Ti, Zr, Hf, Ta, Sc, Y, La, and Ce. The combined weight of Cr, Al, Si and mixtures thereof are of at least about 12 wt % based on the weight of the binder (RS). The reactive wetting element is about 0.01 wt % to about 2 wt %, preferably about 0.01 wt % to about 1 wt % of based on the weight of the binder. The alloying metal S can further comprise a corrosion resistant element selected from the group consisting of Al, Si, Nb, Mo and mixtures thereof. The corrosion resistance elements provide for superior corrosion resistance. The reactive wetting elements provide enhanced wetting by reducing the contact angle between the ceramic phase (PQ) and molten binder phase (RS) in the temperature range of 1500° C. to 1750° C. One method to add the reactive wetting element such as Ce and La is to add suitable amounts of Misch metal. Misch metal is mixed rare earth elements of the Long Form of the Periodic Table of Elements and is known to one of ordinary skill in the art. These elements can be added as a pure element during mixing of the oxide and metal powder in processing or can be part of the metal powder prior to mixing with oxide powder.

In the oxide cermet composition the binder phase (RS) is in the range of 5 to 70 vol %, preferably 5 to 45 vol %, and more preferably 10 to 30 vol % based on the volume of the cermet. The mass ratio of R to S can vary in the range from 50/50 to 90/10. In one preferred embodiment the chromium content in the binder phase (RS) is at least 12 wt % based on the weight of the binder (RS). In another preferred embodiment the combined zirconium and hafnium content in the binder phase (RS) is about 0.01 wt % to about 2.0 wt % based on the total weight of the binder phase (RS).

The cermet composition can further comprise secondary oxides (P'Q) wherein P' is selected from the group consisting of Al, Si, Mg, Ca, Y, Fe, Mn, Ni, Co, Cr, Ti, Zr, Hf, Ta, Sc, La, and Ce and mixtures thereof. Stated differently, the secondary oxides are derived from the metal elements from P, R, S and combinations thereof of the cermet composition (PQ)(RS). The ratio of P' to Q in (P'Q) can vary in the range of 0.5:1 to 1:2.5. The total ceramic phase volume in the cermet of the instant invention includes both (PQ) and the secondary oxide (P'Q). In the oxide cermet composition (PQ)+(P'Q) ranges from of about 30 to 95 vol % based on the volume of the cermet. Preferably from about 55 to 95 vol % based on the volume of the cermet. More preferably from 70 to 90 vol % based on the volume of the cermet.

The volume percent of cermet phase (and cermet components) excludes pore volume due to porosity. The cermet can be characterized by a porosity in the range of 0.1 to 15 vol %. Preferably, the volume of porosity is 0.1 to less than 10% of the volume of the cermet. The pores comprising the porosity is preferably not connected but distributed in the cermet body as discrete pores. The mean pore size is preferably the same or less than the mean particle size of the ceramic phase (PQ).

One aspect of the invention is the micromorphology of the cermet. The ceramic phase can be dispersed as spherical, ellipsoidal, polyhedral, distorted spherical, distorted ellipsoidal and distorted polyhedral shaped particles or platelets. Preferably, at least 50% of the dispersed particles is such that the particle-particle spacing between the individual oxide ceramic particles is at least 1 nm. The particle-particle spacing may be determined for example by micro-copy methods such as SEM and TEM.

The cermet compositions of the instant invention possess enhanced erosion and corrosion properties. The erosion rates were determined by the Hot Erosion and Attrition Test (HEAT) as described in the examples section of the disclosure. The erosion rate of the oxide cermets of the instant invention is less than $1.0\times10^{-6}$ cc/gram of SiC erodant. The corrosion rates were determined by thermogravimetric (TGA) analyses as described in the examples section of the disclosure. The corrosion rate of the oxide cermets of the instant invention is less than $1\times10^{-11}$ $g^2/cm^4\cdot s$.

The cermet compositions possess fracture toughness of greater than about 1.0 $MPa\cdot m^{1/2}$, preferably greater than about 3 $MPa\cdot m^{1/2}$, and more preferably greater than about 5 $MPa\cdot m^{1/2}$. Fracture toughness is the ability to resist crack propagation in a material under monotonic loading conditions. Fracture toughness is defined as the critical stress intensity factor at which a crack propagates in an unstable manner in the material. Loading in three-point bend geometry with the pre-crack in the tension side of the bend sample is preferably used to measure the fracture toughness with fracture mechanics theory. (RS) phase of the cermet of the instant invention as described in the earlier paragraphs is primarily responsible for imparting this attribute.

The cermet compositions are made by general powder metallurgical technique such as mixing, milling, pressing, sintering and cooling, employing as starting materials a suitable ceramic powder and a binder powder in the required volume ratio. These powders are milled in a ball mill in the presence of an organic liquid such as ethanol for a time sufficient to substantially disperse the powders in each other. The liquid is removed and the milled powder is dried, placed in a die and pressed into a green body. The resulting green body is then sintered at temperatures above about 1200° C. up to about 1750° C. for times ranging from about 10 minutes to about 4 hours. The sintering operation is preferably performed in an inert atmosphere or under vacuum. For example, the inert atmosphere can be argon and the reducing atmosphere can be hydrogen. Thereafter the sintered body is allowed to cool, typically to ambient conditions. The cermet production according to the process described herein allows fabrication of bulk cermet bodies exceeding 7 mm in thickness.

Another aspect of the invention is the avoidance of embrittling inter-metallic precipitates such as sigma phase known to one of ordinary skill in the art of metallurgy. The oxide cermet of the instant invention has preferably less than about 5 vol % of such embrittling phases. The cermet of the instant invention with (PQ) and (RS) phases as described in the earlier paragraphs is responsible for imparting this attribute.

One feature of the cermets of the invention is their microstructural stability, even at elevated temperatures, making them particularly suitable for use in protecting metal surfaces against erosion at temperatures up to about 1150° C. It is believed this stability permits their use for time periods greater than 2 years, for example for about 2 years to about 10 years. In contrast many known cermets undergo transformations at elevated temperatures which results in the formation of phases which have a deleterious effect on the properties of the cermet.

The high temperature stability of the cermets of the invention makes them suitable for applications where refractories are currently employed. A non-limiting list of suitable uses include liners for process vessels, transfer lines, cyclones, for example, fluid-solids separation cyclones as in the cyclone of Fluid Catalytic Cracking Unit used in refining industry, grid inserts, thermo wells, valve bodies, slide valve gates and guides, catalyst regenerators, and the like. Thus, metal surfaces exposed to erosive or corrosive environments, especially at about 300° C. to about 1150° C. are protected by providing the surface with a layer of the cermet compositions of the invention. The cermets of the instant invention can be affixed to metal surfaces by mechanical means or by welding.

EXAMPLES

Determination of Volume Percent:

The volume percent of each phase, component and the pore volume (or porosity) were determined from the 2-dimensional area fractions by the Scanning Electron Microscopy method. Scanning Electron Microscopy (SEM) was conducted on the sintered cermet samples to obtain a secondary electron image preferably at 1000× magnification. For the area scanned by SEM, X-ray dot image was obtained using Energy Dispersive X-ray Spectroscopy (EDXS). The SEM and EDXS analyses were conducted on five adjacent areas of the sample. The 2-dimensional area fractions of each phase was then determined using the image analysis software: EDX Imaging/Mapping Version 3.2 (EDAX Inc, Mahwah, N.J. 07430, USA) for each area. The arithmetic average of the area fraction was determined from the five measurements. The volume percent (vol %) is then determined by multiplying the average area fraction by 100. The vol % expressed in the examples have an accuracy of +/−50% for phase amounts measured to be less than 2 vol % and have an accuracy of +/−20% for phase amounts measured to be 2 vol % or greater.

Determination of Weight Percent:

The weight percent of elements in the cermet phases was determined by standard EDXS analyses.

The following non-limiting examples are included to further illustrate the invention.

Example 1

Reactive-Wetting

Figure 2A:
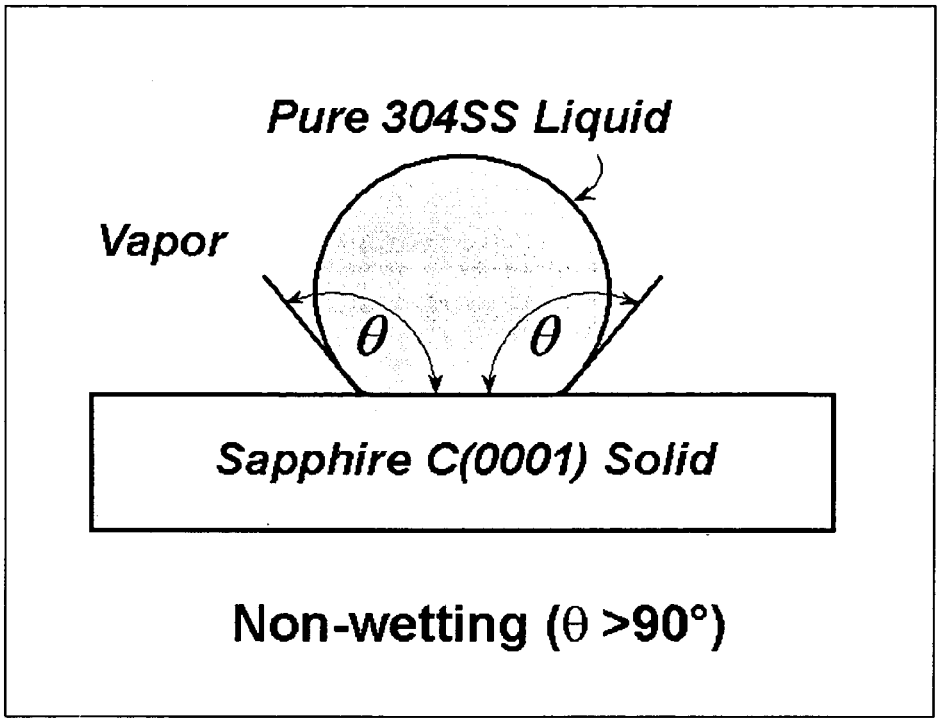
FIGS. 2*a* and 2*b* are illustration of the wetting step in accordance with the invention.
Figure 2B:
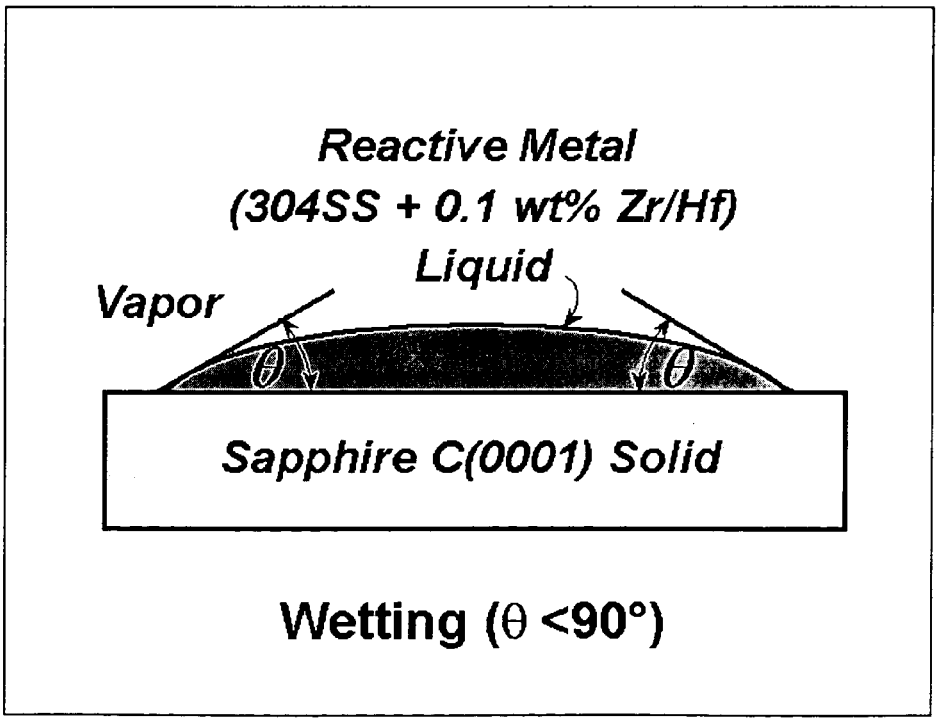
Figure 3:
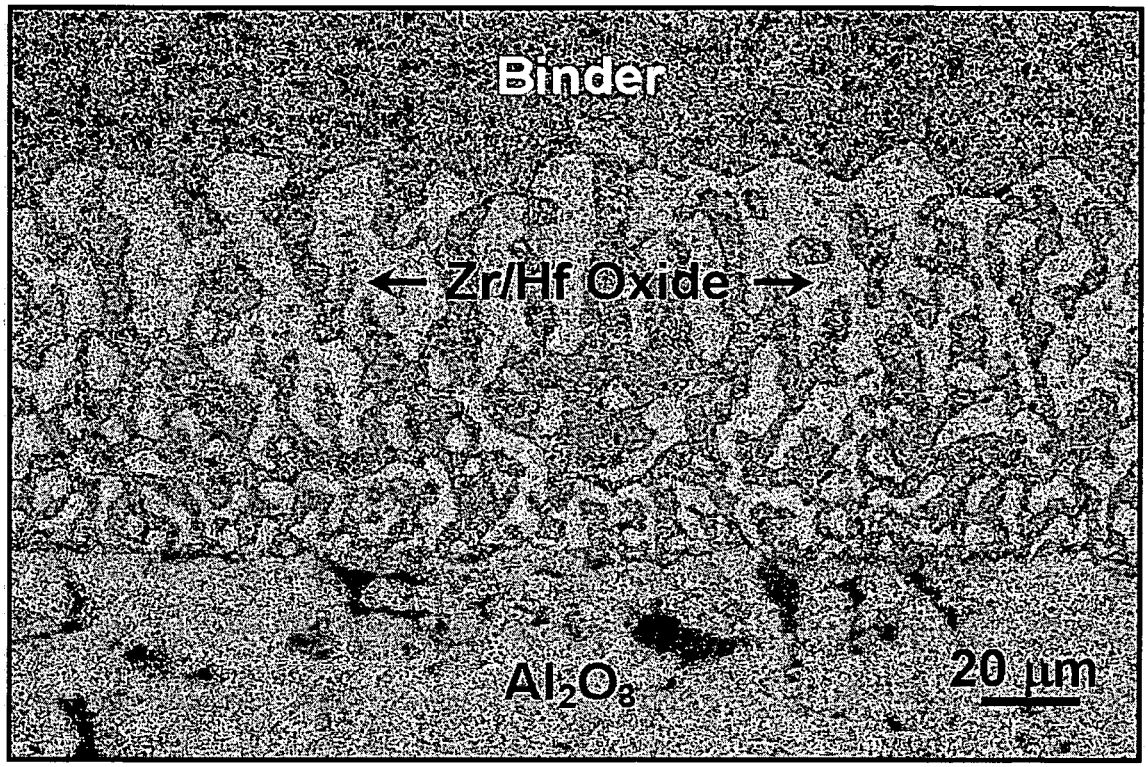
FIG. 3 is a combined X-ray image obtained in scanning electron microscopy (SEM) of alumina and M304SS interface after wetting experiment.

The usefulness of the addition of reactive wetting elements in the binders is to promote wetting of molten binder on ceramics by reducing contact angle. Contact angle measurement was made to quantify the wetting phenomenon. The alloy binder containing various amount of reactive wetting element (i.e., 0.9 wt % Zr and 0.4 wt % Hf) based on the weight of the binder was placed on top of a polished substrate of the single crystal (i.e., C (0001) plane sapphire) and heated to 1700° C. for 10 minutes in high vacuum furnace ($1\times10^{-6}$ torr). After cooling the sample to ambient temperature, the contact angle was then measured by cross sectional electron microscopy. As an example, contact angle data for 304SS is presented in FIG. 1, which shows change of contact angle as a function of various concentration of Zr/Hf. This figure illustrates 0.1 wt % of Zr/Hf reduces contact angle from 160° to 33°. FIGS. 2*a* and 2*b* illustrates the wetting steps in accordance with the invention. FIG. 3 is a combined X-ray image obtained using SEM at the alumina-M304SS (Fe(balance):18.2Cr:8.7Ni:1.3Mn:0.9Zr:0.42Si:0.4Hf) binder interface after wetting experiment at 1700° C. for 10 minutes in high vacuum furnace ($10^{-6}$ torr), wherein the bar represents 20 μm. In this image both binder and alumina phases appear dark. The reaction product which is mixed Zr/Hf oxide phase appears light.

Example 2

Raw Material Powders and Erosion Testing

Alumina powder was obtained from various sources. Table 1 lists alumina powder used for high temperature erosion/corrosion resistant oxide cermets.

TABLE 1

| Company | Grade | Purity | Size |
|---|---|---|---|
| Alfa Aesar | $\alpha$-$Al_2O_3$ | 99.99% | 1 μm |
| Alcoa | Tabular Alumina T-64 | 99.4% | −8 mesh |
| Alcoa | Tabular Alumina T-64 | 99.4% | 3–6 mesh |
| Alcoa | Tabular Alumina T-64 | 99.4% | 6–14 mesh |
| Alcoa | Tabular Alumina T-64 | 99.4% | 8–14 mesh |
| Alcoa | Tabular Alumina T-64 | 99.4% | 14–28 mesh |
| Alcoa | Tabular Alumina T-64 | 99.4% | 28–48 mesh |

Metal alloy powders that were prepared via Ar gas atomization method were obtained from Osprey Metals (Neath, UK). Metal alloy powders that were reduced in size, by conventional size reduction methods to a particle size, desirably less than 20 μm, preferably less than 5 μm, where more than 95% alloy binder powder were screened below 16 μm. As an example, M304SS powder used in the experiment were more than 96.2% alloy binder powder screened below 16 μm.

Erosion Rate was measured as the volume of cermet, refractory, or comparative material removed per unit mass of erodant particles of a defined average size and shape entrained in a gas stream, and had units of cc/gram (e.g., <0.001 cc/1000 gram of SiC). Erodant material and size distribution, velocity, mass flux, angle of impact of the erodant as well as erosion test temperature and chemical environment influence erosion.

Erosion loss of cermet was measured by the Hot Erosion and Attrition Test (HEAT). Cermet specimen blocks of about 2 inch square and about 0.5 inch thickness were weighed to an accuracy of ±0.01 mg. The center of one side of the block was subjected to 1200 g/min of SiC particles entrained in an air jet exiting from a riser tube with a 0.5 inch diameter where the end of the riser tube was 1 inch from the target disk. The 58 μm angular SiC particles used as the erodant were 220 grit #1 Grade Black Silicon Carbide (UK Abrasives, Inc., Northbrook, Ill.). The erodant velocity impinging on cermet targets was 45.7 m/sec (150 ft/sec) and the impingement angle of the gas-erodant stream on the target was 450°±50°, preferably 45°±2° between the main axis of the riser tube and the surface of the specimen disk. The carrier gas was heated air for all tests. The erosion tests in the HEAT unit were performed at 732° C. (1350° F.) for 7 hours. After completion of exposure to the erodant and cooling to ambient temperature the cermet specimens were again weighed to an accuracy of ±0.01 mg to determine the weight loss. The erosion rate was equal to the volume of material removed per unit mass of erodant particles entrained in the gas stream, and has units of cc/gram. Improvement in Table 2 is the reduction of weight loss due to erosion compared to a value of 1.0 for the standard RESCOBOND™ AA-22S (Resco Products, Inc., Pittsburgh, Pa.). AA-22S typically comprises at least 80.0% $Al_2O_3$, 7.2% $SiO_2$, 1.0% $Fe_2O_3$, 4.8% MgO/CaO, 4.5% $P_2O_5$ in wt % Micrographs of the eroded surface were electron microscopically taken to determine damage mechanisms. The HEAT test measures very aggressive erodant particles. More typical particles are softer and cause lower erosion rates. For example FCCU catalysts are based on alumina silicates which are softer than aluminas which are much softer than SiC.

Example 3

Alumina-Modified 304SS Cermet 70 vol % of 1 μm average diameter of $\alpha$-$Al_2O_3$ powder (99.99% purity, from Alfa Aesar) and 30 vol % of 6.7 μm average diameter modified M304SS powder (Osprey Metals, 96.2% screened below −16 μm) were dispersed with ethanol in HDPE milling jar. The powders in ethanol were mixed for 24 hours with Yttria Toughened Zirconia (YTZ) balls (10 mm diameter, from Tosoh Ceramics) in a ball mill at 100 rpm. The ethanol was removed from the mixed powders by heating at 130° C. for 24 hours in a vacuum oven. The dried powder was compacted in a 40 mm diameter die in a hydraulic uniaxial press (SPEX 3630 Automated X-press) at 5,000 psi. The resulting green disc pellet was ramped up to 400° C. at 25° C./min in argon and held at 400° C. for 30 min for residual solvent removal. The disc was then heated to 1700° C. in high vacuum ($10^{-6}$ torr) and held at 1700° C. for 1 hour. The temperature was then reduced to below 100° C. at −15° C./min.

The resultant cermet comprised:

i) 70 vol % $Al_2O_3$ with average grain size of about 4 μm
ii) 1 vol % secondary Zr/Hf oxide with average grain size of about 0.7 μm
iii) 29 vol % Zr/Hf-depleted alloy binder.

Table 2 summarizes the erosion loss of the cermet as measured by the HEAT. The cermet compositions exhibited an erosion rate less than about $1\times10^{-6}$ cc/gram loss when subject to 1200 g/min of 10 μm to 100 μm SiC particles in air with an impact velocity of at least about 45.7 m/sec (150 ft/sec) and at an impact angle of about 45 degrees and a temperature of at least about 732° C. (1350° F.) for at least 7 hours.

TABLE 2

| Cermet {Example} | Starting Weight (g) | Finish Weight (g) | Weight Loss (g) | Bulk Density (g/cc) | Erodant (g) | Erosion (cc/g) | Improvement [(Normalized erosion)$^{-1}$] |
|---|---|---|---|---|---|---|---|
| $Al_2O_3$-30 vol % M304SS | 16.6969 | 14.7379 | 1.9590 | 5.130 | 5.04E+5 | 7.5768E−7 | 1.4 |

Figure 4:
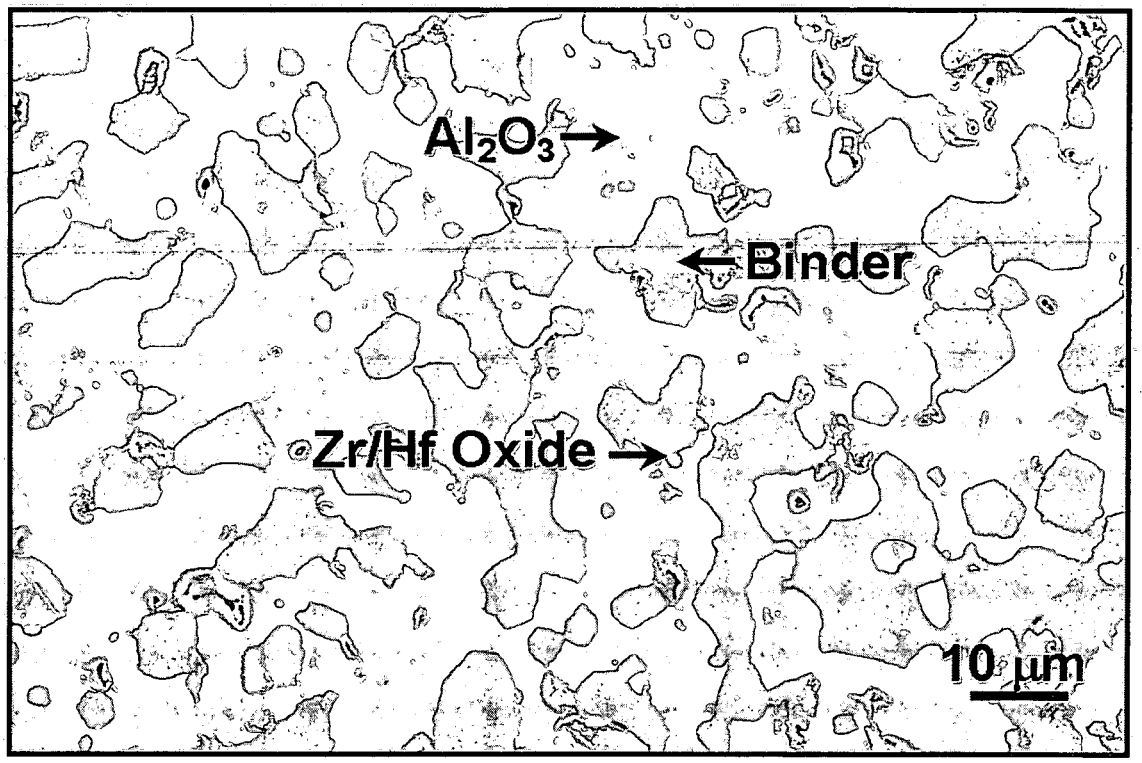
FIG. 4 is a SEM image of 70 vol % $Al_2O_3$ cermet made using 30 vol % M304SS binder.
Figure 5:
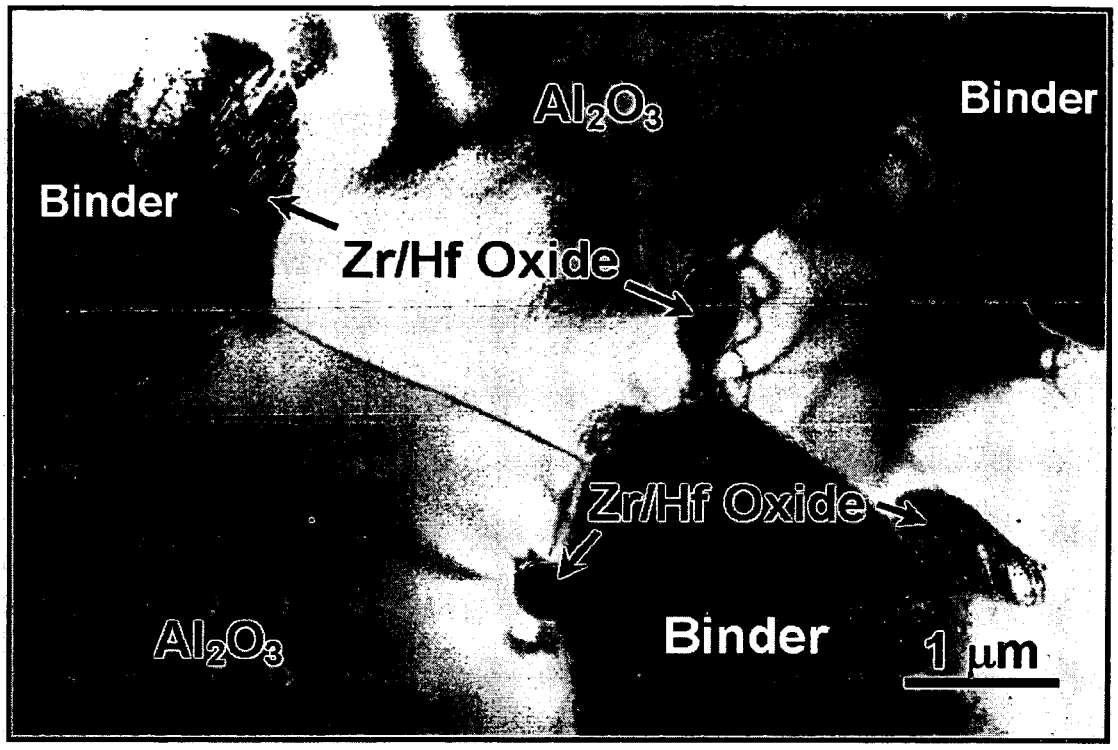
FIG. 5 is a transmission electron microscopy (TEM) image of the same cermet shown in FIG. 4.

FIG. 4 is a SEM image of $Al_2O_3$ cermet processed according to this example, wherein the bar represents 10 μm. In this image the $Al_2O_3$ phase appears dark and the binder phase appears light. The new secondary Zr/Hf oxide phase is also shown at the binder/alumina interface. FIG. 5 is a TEM image of selected area in FIG. 4, wherein the bar represents 1 μm. In this image the new secondary Zr/Hf oxide phase appears dark at the binder/alumina interface. The metal element (M) of the secondary metal oxide phase comprises of about 70Zr:30Hf in wt %. The binder phase is depleted in Zr/Hf due to the precipitation of secondary Zr/Hf oxide phase.

Example 4

Alumina-Modified 304SS Cermet 70 vol % of tabular alumina (99.4% purity, from Alcoa, 90% screened below 8 mesh) and 30 vol % of 6.7 μm average diameter M304SS powder (Osprey Metals, 96.2% screened below −16 μm) were placed in HDPE milling jar. The powders were mixed for 24 hours in a ball mill at 100 rpm without liquid medium. The mixed powder was compacted in a 40 mm diameter alumina crucible at 1,000 psi. The compacted pellet was then heated to 1700° C. in high vacuum ($10^{-6}$ torr) and held at 1700° C. for 1 hour. The temperature was then reduced to below 100° C. at −15° C./min.

The resultant cermet comprised:

i) 70 vol % $Al_2O_3$ with various grit size (−8 mesh)
ii) 1 vol % secondary Zr/Hf oxide with average grain size of about 1 μm
iii) 29 vol % Zr/Hf-depleted alloy binder.

Figure 6:
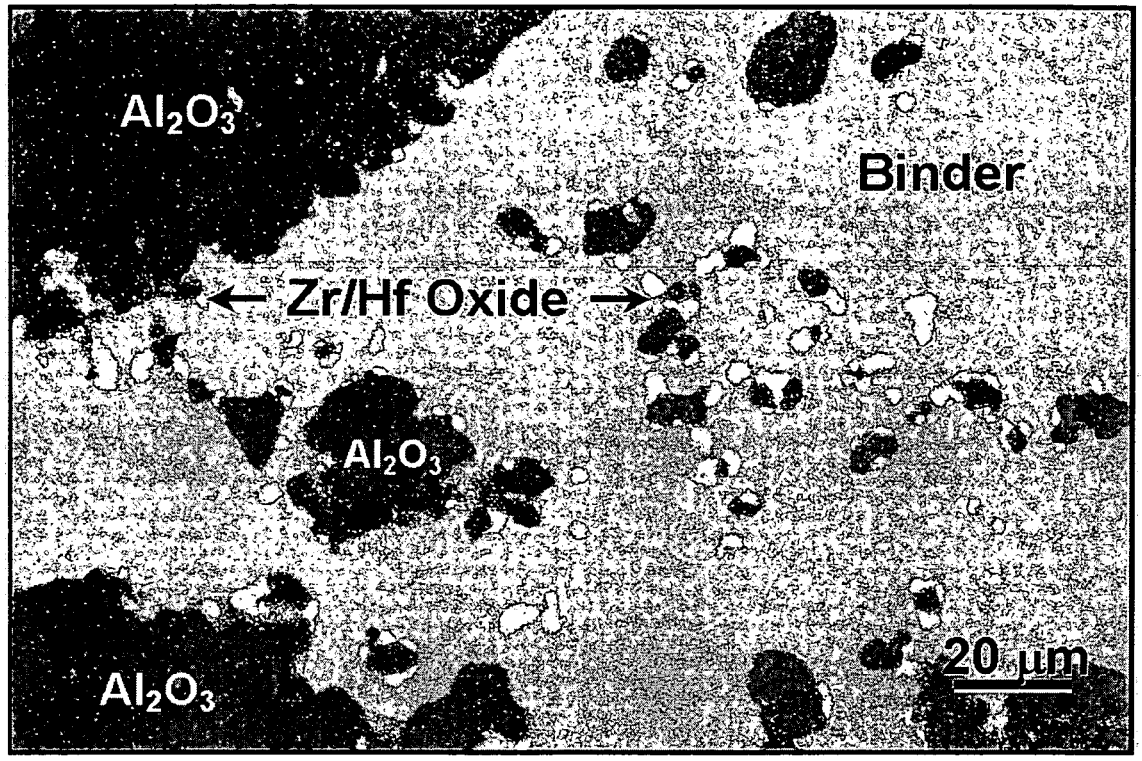
FIG. 6 is a SEM image of 70 vol % tabular $Al_2O_3$ cermet made using 30 vol % M304SS binder.

FIG. 6 is a combined X-ray image obtained using a SEM, wherein the bar represents 20 μm. In this image, $Al_2O_3$ phase appears dark and the binder phase appears light. The secondary Zr/Hf oxide phase as a result of reactive wetting is also shown white at the binder/alumina interface.

Example 5

Close Packed Alumina-Modified 304SS Cermet

The ceramic particles were sized to obtain close packing as an option. In this case mesh size is used as a measurement of particle size. It is obtained by sieving various sized particles through a screen (mesh). A mesh number indicates the number of openings in a screen per square inch. In other words, a mesh size of 100 would use a screen that has 10 wires per linear inch in both a horizontal and vertical orientation yielding 100 openings per square inch. A "+" before the mesh size indicates that particles are retained on and are larger than the sieve. A "−" before the mesh size indicates the particles pass through and are smaller than the sieve. For example, −48 mesh indicates the particles pass through and are smaller than the openings of a 48 mesh (388 μm) sieve. Typically 90% or more of the particles will fall within the specified mesh. Often times, mesh size is expressed by two numbers (i.e., 28/48). This translates to a range in particle sizes that will fit between two screens. The top screen will have 28 openings per square inch and the bottom screen will have 48 openings per square inch. For example, one could narrow down the range of particle sizes in a batch of packing material to contain particles from 388 μm to 707 μm. First, sieve it through a screen with a mesh size of 28 (28 openings per square inch) which particles smaller than 707 μm to pass through. Then, use a second screen with a mesh size of 48 (48 openings per square inch), after the first mesh, and particles smaller than 388 μm will pass through. Between the two screens you would have a range in particles from 388 μm to 707 μm. This batch of ceramic could then be expressed as having a mesh size of 28/48. Table 3 shows a preferred formulation for closely packed ceramic in this invention.

TABLE 3

| Ceramic Mesh Size | Approximate Micron size (μm) | Volume Fraction (%) |
|---|---|---|
| 3/6 | 7097~3350 | 20 |
| 6/14 | 3350~1680 | 15 |
| 8/14 | 2380~1680 | 12 |
| 14/28 | 1680~707 | 7 |
| 28/48 | 707~388 | 15 |
| −48 | −388 | 10 |
| −100 | −149 | 10 |
| −325 | −44 | 6 |
| −635 | −20 | 5 |
| Total | | 100 |

70 vol % of tabular alumina (99.4% purity, from Alcoa) formulation based on table 3 and 30 vol % of 6.7 μm average diameter M304SS powder (Osprey Metals, 96.2% screened below −16 μm) were placed in HDPE milling jar. The powders were mixed for 24 hours in a ball mill at 100 rpm without liquid medium. The mixed powder was compacted in a 40 mm diameter alumina crucible at 1,000 psi. The compacted pellet was then heated to 1700° C. in high vacuum ($10^{-6}$ torr) and held at 1700° C. for 1 hour. The temperature was then reduced to below 100° C. at −15° C./min.

The resultant cermet comprised:

i) 70 vol % $Al_2O_3$ with various grit size ii) 1 vol % secondary Zr/Hf oxide with average grain size of about 1 μm iii) 29 vol % Zr/Hf-depleted alloy binder.

Example 6

Corrosion Testing

Each of the cermets of Examples 3, 4, and 5 was subjected to an oxidation test. The procedure employed was as follows:

1) A specimen cermet of about 10 mm square and about 1 mm thick was polished to 600 grit diamond finish and cleaned in acetone.

2) The specimen was then exposed to 100 cc/min air at 800° C. in thermogravimetric analyzer (TGA).

3) Step (2) was conducted for 65 hours at 800° C.

4) After 65 hours the specimen was allowed to cool to ambient temperature.

5) Thickness of oxide scale was determined by cross sectional microscopy examination of the corrosion surface.

The thickness of oxide scale formed preferentially on binder phase was ranging about 0.5 μm to about 1.5 μm. The cermet compositions exhibited a corrosion rate less than about $1\times10^{-11}$ $g^2/cm^4\cdot s$ with an average oxide scale of less than 30 μm thickness when subject to 100 cc/min air at 800° C. for at least 65 hours.

The invention claimed is:

1. A cermet composition represented by the formula (PQ)(RS) comprising: a ceramic phase (PQ) and a binder phase (RS) wherein, P is a metal selected from the group consisting of Al, Si, Mg, Ca, Y, Fe, Mn, Group IV, Group V, Group VI elements, and mixtures thereof, Q is oxide, R is a base metal selected from the group consisting of Fe, Ni Co, Mn and mixtures thereof, S consists essentially of at least one element selected from the group consisting of Cr, Al and Si and at least one reactive wetting element selected from the group consisting of Ti, Zr, Hf, Ta, Sc, Y, La, and Ce, and wherein the ceramic phase (PQ) ranges from of about 55 to 95 vol % based on the volume of the cermet and is dispersed in the binder phase (RS) in a closely packed arrangement wherein about 54 vol % of the ceramic phase (PQ) is between about 707 microns and about 7097 microns in diameter and about 46% of the ceramic phase (PQ) is between about 20 microns and about 707 microns in diameter.

2. The cermet composition of claim 1 wherein the molar ratio of P:Q in the ceramic phase (PQ) can vary in the range of 0.5:1 to 1:2.5.

3. The cermet composition of claim 1 wherein the binder phase (RS) is in the range of about 5 to 45 vol % based on the volume of the cermet and the mass ratio of R to S ranges from 50/50 to 90/10.

4. The cermet composition of claim 3 wherein the combined weights of said Cr, Al and Si and mixtures thereof is at least 12 wt % based on the weight of the binder phase (RS).

5. The cermet composition of claim 1 wherein said reactive wetting element selected from the group consisting of Ti, Zr, Hf, Ta, Se, Y, La and Ce is in the range of 0.01 to 2 wt % based on the total weight of the binder phase (RS).

6. The cermet composition of claim 1 further comprising secondary oxides (P'Q) wherein P' is selected from the group consisting of Al, Si, Mg, Ca, Y, Fe, Mn, Ni, Co, Cr, Ti, Zr, Hf, Ta, Sc, La, and Ce and mixtures thereof.

7. The cermet composition of claim 1 having an erosion rate less than about $1\times10^{6}$ cc/gram of SiC erodant.

8. The cermet composition of claim 1 having corrosion rate less than about $1\times10^{-11}$ $g^2/cm^4\cdot s$ or an average oxide scale of less than 30 μm thickness when subject to 100 cc/min air at 800° C. for at least 65 hours.

9. The cermet composition of claim 1 having an erosion rate less than about $1\times10^{-6}$ cc/gram of SiC erodant and a corrosion rate less than about $1\times10^{-11}$ $g^2/cm^4\cdot s$ or an average oxide scale of less than 30 μm thickness when subject to 100 cc/min air at 800° C. for at least 65 hours.

10. The cermet composition of claim 1 having embrittling phases less than about 5 vol % based on the volume of the cermet.

11. The cermet composition of claim 1 having a fracture toughness greater than about 1.0 MPa $m^{1/2}$.

12. A bulk cermet material represented by the formula (PQ)(RS) comprising: a ceramic phase (PQ) and a binder phase (RS) wherein, P is a metal selected from the group consisting of Al, Si, Mg, Ca, Y, Fe, Mn, Group IV, Group V, Group VI elements, and mixtures thereof, Q is oxide, R is a base metal selected from the group consisting of Fe, Ni Ce, Mn arid mixtures thereof, S consists essentially of at least one element selected from the group consisting of Cr, Al and Si and at least one reactive wetting element selected from the group consisting of Ti, Zr, Hf, Ta, Sc, Y, La, and Ce, wherein the overall thickness of the bulk cermet material is greater than 7 millimeters, and wherein the ceramic phase (PQ) ranges from about 30 to 95 vol % based on the volume of the cermet, and is dispersed in the binder phase (RS) in a closely packed arrangement wherein about 54 vol % of the ceramic phase (PQ) is between about 707 microns and about 7097 microns in diameter and about 46% of the ceramic phase (PQ) is between about 20 microns and about 707 microns in diameter.

13. The cermet composition of claim 12 wherein the molar ratio of P:Q in the ceramic phase (PQ) can vary in the range of 0.5:1 to 1:2.5.

14. The cermet composition of claim 12 wherein (PQ) ranges from about 55 to 95 vol % based on the volume of the cermet.

15. The cermet composition of claim 12 wherein the binder phase (RS) is in the range of 5 to 70 vol % based on the volume of the cermet and the mass ratio of R to S ranges from 50/50 to 90/10.

16. The cermet composition of claim 15 wherein the combined weights of said Cr Al and Si and mixtures thereof is at least 12 wt % based on the weight of the binder phase (RS).

17. The cermet composition of claim 12 wherein said reactive wetting element selected from the group consisting of Ti, Zr, Hf, Ta, Sc, Y, La and Ce is in the range of 0.01 to 2 wt % based on the total weight of the binder phase (RS).

18. The cermet composition of claim 12 further comprising secondary oxides (P'Q) wherein P' is selected from the group consisting of Al, Si, Mg, Ca, Y, Fe, Mn, Ni, Co, Cr, Ti, Zr, Hf, Ta, Sc, La, and Ce and mixtures thereof.

19. The cermet composition of claim 12 having an erosion rate less than about $1\times10^{-6}$ cc/gram of SiC erodant.

20. The cermet composition of claim 12 having corrosion rate less than about $1\times10^{-11}$ $g^2/cm^4\cdot s$ or an average oxide scale of less than 30 μm thickness when subject to 100 cc/min air at 800° C. for at least 65 hours.

21. The cermet composition of claim 12 having an erosion rate less than about $1\times10^{-6}$ cc/gram of SiC erodant and a corrosion rate less than about $1\times10^{-11}$ $g^2/cm^4\cdot s$ or an average oxide scale of less than 30 μm thickness when subject to 100 cc/min air at 800° C. for at least 65 hours.

22. The cermet composition of claim 12 having embrittling phases less than about 5 vol % based on the volume of the cermet.

23. The cermet composition of claim 12 having a fracture toughness greater than about 1.0 MPa $m^{1/2}$.

* * * * *